US010745232B2

(12) United States Patent
Okabe

(10) Patent No.: US 10,745,232 B2
(45) Date of Patent: Aug. 18, 2020

(54) IMAGE FORMING APPARATUS, IMAGE FORMING METHOD, AND NON-TRANSITORY COMPUTER-READABLE STORAGE MEDIUM

(71) Applicant: Yuusuke Okabe, Kanagawa (JP)

(72) Inventor: Yuusuke Okabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/291,137

(22) Filed: Mar. 4, 2019

(65) Prior Publication Data

US 2019/0276256 A1 Sep. 12, 2019

(30) Foreign Application Priority Data

Mar. 9, 2018 (JP) ..... 2018-043622

(51) Int. Cl.

| | |
|---|---|
| ***B65H 31/24*** | (2006.01) |
| ***B65H 7/02*** | (2006.01) |
| ***B65H 29/58*** | (2006.01) |
| ***B65H 43/06*** | (2006.01) |
| ***B65H 43/02*** | (2006.01) |

(52) U.S. Cl.

CPC ..... *B65H 31/24* (2013.01); *B65H 7/02* (2013.01); *B65H 29/58* (2013.01); *B65H 43/02* (2013.01); *B65H 43/06* (2013.01); *B65H 2405/10* (2013.01); *B65H 2405/15* (2013.01); *B65H 2511/152* (2013.01); *B65H 2511/30* (2013.01);

(Continued)

(58) Field of Classification Search

CPC .. B65H 43/06; B65H 2511/152; B65H 31/24; B65H 2515/10; B65H 43/02; B65H 2405/15; B65H 2511/30

See application file for complete search history.

(56) References Cited

U.S. PATENT DOCUMENTS

| | | | | |
|---|---|---|---|---|
| 7,245,871 | B2 * | 7/2007 | Kasahara | B65H 31/24 271/290 |
| 8,282,098 | B2 * | 10/2012 | Hayashi | B65H 31/36 271/287 |

(Continued)

FOREIGN PATENT DOCUMENTS

| | | |
|---|---|---|
| JP | 8-245044 | 9/1996 |
| JP | 2011-201676 | 10/2011 |

(Continued)

*Primary Examiner* — Jeremy R Severson

(74) *Attorney, Agent, or Firm* — Harness, Dickey & Pierce, P.L.C.

(57) ABSTRACT

An image forming apparatus performs printing of a plurality of copies of a document in response to execution of a printing job. Each copy includes a plurality of sheets. The image forming apparatus includes a first ejection tray; a second ejection tray; and a first sensor; and circuitry. The circuitry is configured to: start sheet ejection to the first ejection tray; switch a sheet-ejection destination to the second ejection tray in response to detecting that the first ejection tray is at a full level during printing of a first copy; calculate an amount of vacant space of the second ejection tray in response to completion of the printing of the first copy; and perform printing of a second copy to the second ejection tray or to suspend the execution of the printing job, based on the amount of vacant space.

13 Claims, 11 Drawing Sheets

(52) U.S. Cl.
CPC .... *B65H 2515/10* (2013.01); *B65H 2515/112* (2013.01); *B65H 2801/06* (2013.01)

(56) References Cited

U.S. PATENT DOCUMENTS

| | | | | |
|---|---|---|---|---|
| 8,371,577 | B2 * | 2/2013 | Schoenmakers | B65H 33/08 271/176 |
| 8,459,643 | B2 * | 6/2013 | Cheng | B41J 13/106 271/288 |
| 9,388,011 | B2 * | 7/2016 | Mutsuno | B65H 31/24 |
| 2006/0261543 | A1 * | 11/2006 | Miyake | B65H 31/24 271/292 |
| 2010/0044949 | A1 * | 2/2010 | Nakamura | B65H 29/60 271/3.17 |
| 2012/0063833 | A1 | 3/2012 | Yanagida | |
| 2019/0263623 | A1 * | 8/2019 | Itabashi | G06F 3/1264 |

FOREIGN PATENT DOCUMENTS

| | | |
|---|---|---|
| JP | 2012-056266 | 3/2012 |
| JP | 2016-033624 | 3/2016 |

* cited by examiner

| FIG. 6A | FIG. 6B |
|---|---|

| FIG. 8A | |
|---|---|
| | FIG. 8B |

IMAGE FORMING APPARATUS, IMAGE FORMING METHOD, AND NON-TRANSITORY COMPUTER-READABLE STORAGE MEDIUM

CROSS-REFERENCE TO RELATED APPLICATION

This patent application is based on and claims priority pursuant to 35 U.S.C. § 119(a) to Japanese Patent Application No. 2018-043622, filed on Mar. 9, 2018, in the Japan Patent Office, the entire disclosure of which is hereby incorporated by reference herein.

BACKGROUND

Technical Field

The present disclosure relates to an image forming apparatus, an image forming method, and a non-transitory computer-readable storage medium.

Discussion of the Background Art

A technique is known that determines the quantity of sheets stacked on an ejection tray using a sheet stack height sensor mounted on the ejection tray in an image forming apparatus. Further, a technique is known that determines that the ejection tray is full when the sheet stack quantity reaches an upper limit and automatically suspends a job in execution. Furthermore, a technique is known that automatically resumes the suspended job when the stacked sheets are removed.

SUMMARY

An image forming apparatus performs printing of a plurality of copies of a document in response to execution of a printing job as a processing target. Each copy of the plurality of copies of the document includes a plurality of sheets. The image forming apparatus includes: a first ejection tray; a second ejection tray to which a sheet is to be ejected later than the first ejection tray; a first sensor configured to detect a full level and a near full level, which is less than the full level by a predetermined quantity of sheets, based on a quantity of sheets ejected to the first ejection tray or the second ejection tray; and circuitry. The circuitry starts sheet ejection to the first ejection tray in response to the execution of the printing job. The circuitry switches a sheet-ejection destination to the second ejection tray in response to detecting that the first ejection tray is at the full level during printing of a first copy. The circuitry calculates an amount of vacant space of the second ejection tray in response to completion of the printing of the first copy when a part of the plurality of sheets of the first copy is ejected to the second ejection tray. The circuitry performs printing of a second copy to the second ejection tray as the sheet-ejection destination or to suspend the execution of the printing job, based on the calculated amount of vacant space.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
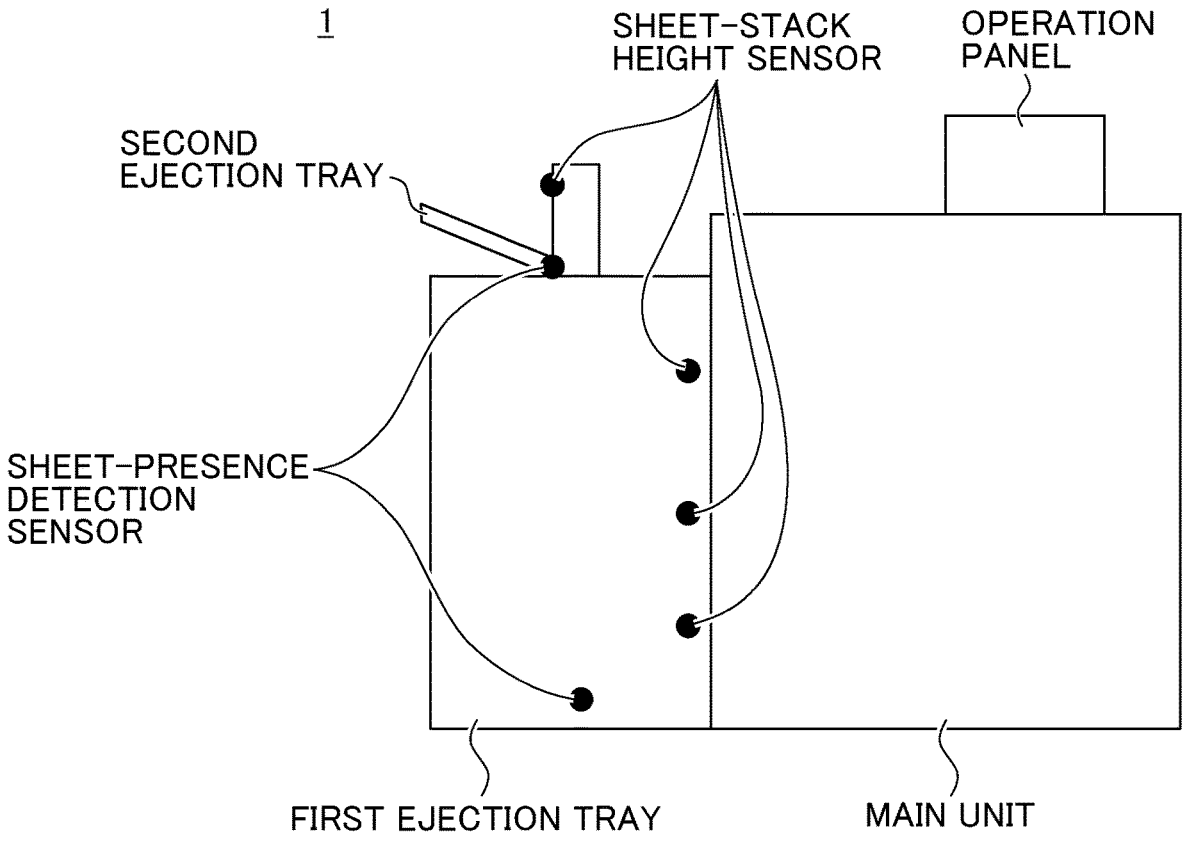
FIG. 1 is a view for describing an example of sensors provided in an image forming apparatus, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

An embodiment of the present disclosure will be described below with reference to the drawings.

FIG. 1 is a view for describing an example of sensors provided in an image forming apparatus 1, according to an embodiment of the present disclosure.

As illustrated in FIG. 1, the image forming apparatus 1 includes a main unit, an operation panel, a first ejection tray, a second ejection tray, a sheet stack height sensor, and a sheet presence sensor.

The main unit has a function of printing a document to perform sheet ejection to the first ejection tray or the second ejection tray. The operation panel has a user-interface function of receiving an instruction for a job start from a user. The first ejection tray and the second ejection tray each can retain a predetermined number of printed sheets to be discharged from the main unit. Sheets may be discharged to the first ejection tray with a higher priority than the second ejection tray.

The sheet stack height sensor is provided at a side portion of an ejection tray and detects the quantity of sheets retained by the first ejection tray or the second ejection tray. The sheet stack height sensor is an example of a first sensor. A plurality of sheet stack height sensors may be provided in addition to the sheet stack height sensor used to detect the full level or near full level of the ejection tray. The full level indicates a case where a bundle of sheets has reached the sensor at the highest position in the ejection tray. The near full level indicates a case where a bundle of sheets has reached the next lower sensor to the sensor at the highest position, the next lower sensor corresponding to a quantity of sheets below the full level. A plurality of sheet stack height sensors may be provided, and the accuracy of detecting a sheet stack quantity improves as the number of provided sensor increases. The sheet stack quantity can be detected with a different method as long as the full level and the near full level can be detected.

The sheet presence detection sensor is provided at the lower portion of an ejection tray, the sheet-presence detection sensor being to detect whether a sheet has been retained by the first ejection tray or the second ejection tray. The sheet presence detection sensor is an example of a second sensor. When the user takes out the sheets being retained in the ejection tray, the sheet presence detection sensor detects that the state of "sheet presence" changes to the state of "sheet absence".

Figure 2:
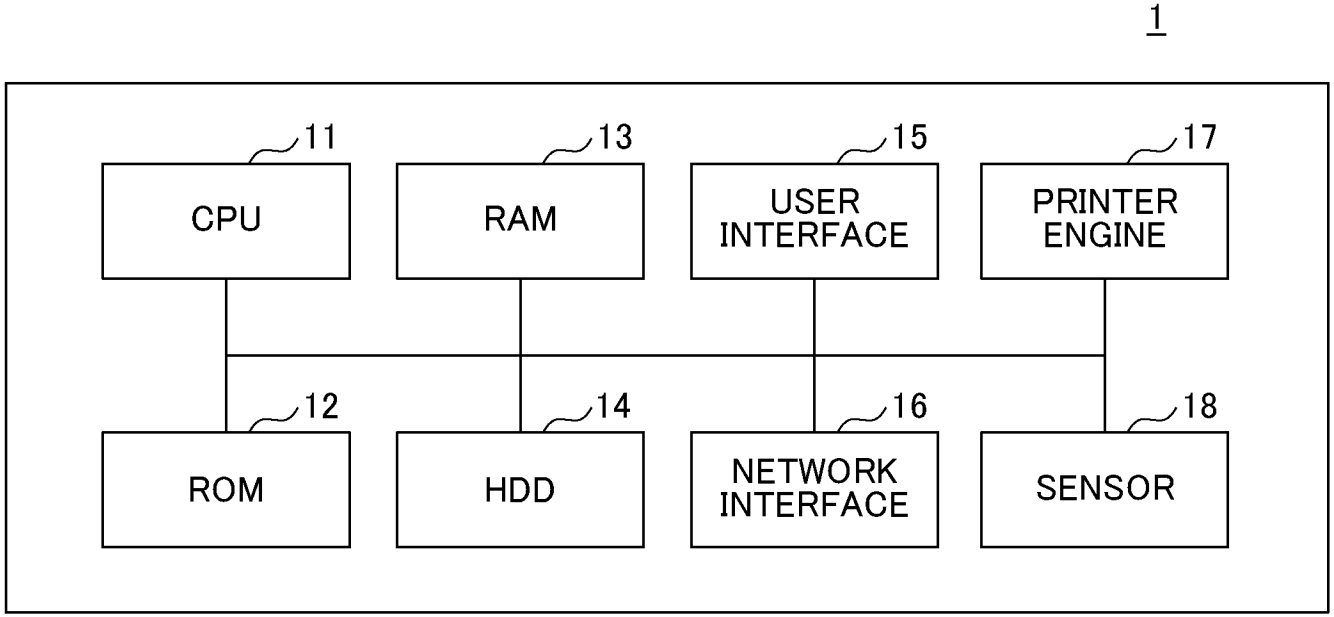
FIG. 2 is a block diagram illustrating an example of a hardware configuration of the image forming apparatus, according to an embodiment of the present disclosure.

FIG. 2 is a block diagram illustrating an example of a hardware configuration of the image forming apparatus 1 according to the embodiment of the present disclosure. As illustrated in FIG. 2, the image forming apparatus l includes a central processing unit (CPU) 11, a read only memory (ROM) 12, a random access memory (RAM) 13, a hard disk drive (HDD) 14, a user interface 15, a network interface 16, a printer engine 17, and a sensor 18.

The CPU 11 including a processor and a peripheral circuit, controls entire operation of the image forming apparatus 1. The ROM 12 includes a non-volatile storage device storing a program to be executed by the CPU 11 and data to be used by the CPU. The RAM 13 includes a storage device to be used as a work area when a program executed by the CPU 11 performs control. The HDD 14 includes an auxiliary storage device storing a program to be executed by the CPU 11 and data to be used by the CPU. Examples of the HDD 14 include a hard disk drive and a storage device constituted as a flash memory.

The user interface 15 includes a display device and an input device that are integrally formed, such as a touch panel. The input device allows the user or an administrator to perform various input operations. The input device may be used for an input operation of the user through a mouse or a keyboard instead of the touch panel. The user interface 15 displays various types of information to the user. The network interface 16 includes a communication device that performs transmission and reception of data through a network 3. For example, the network interface 16 may be a wireless local area network (LAN) interface, a wired LAN interface, or an interface with a communication network with a different scheme.

The printer engine 17 includes hardware that performs printing and performs sheet ejection under the control of the CPU 11. The sensor 18 is hardware of the sheet stack height sensor or the sheet presence detection sensor illustrated in FIG. 1. Examples of the sensor 18 include an optical sensor.

Figure 3:
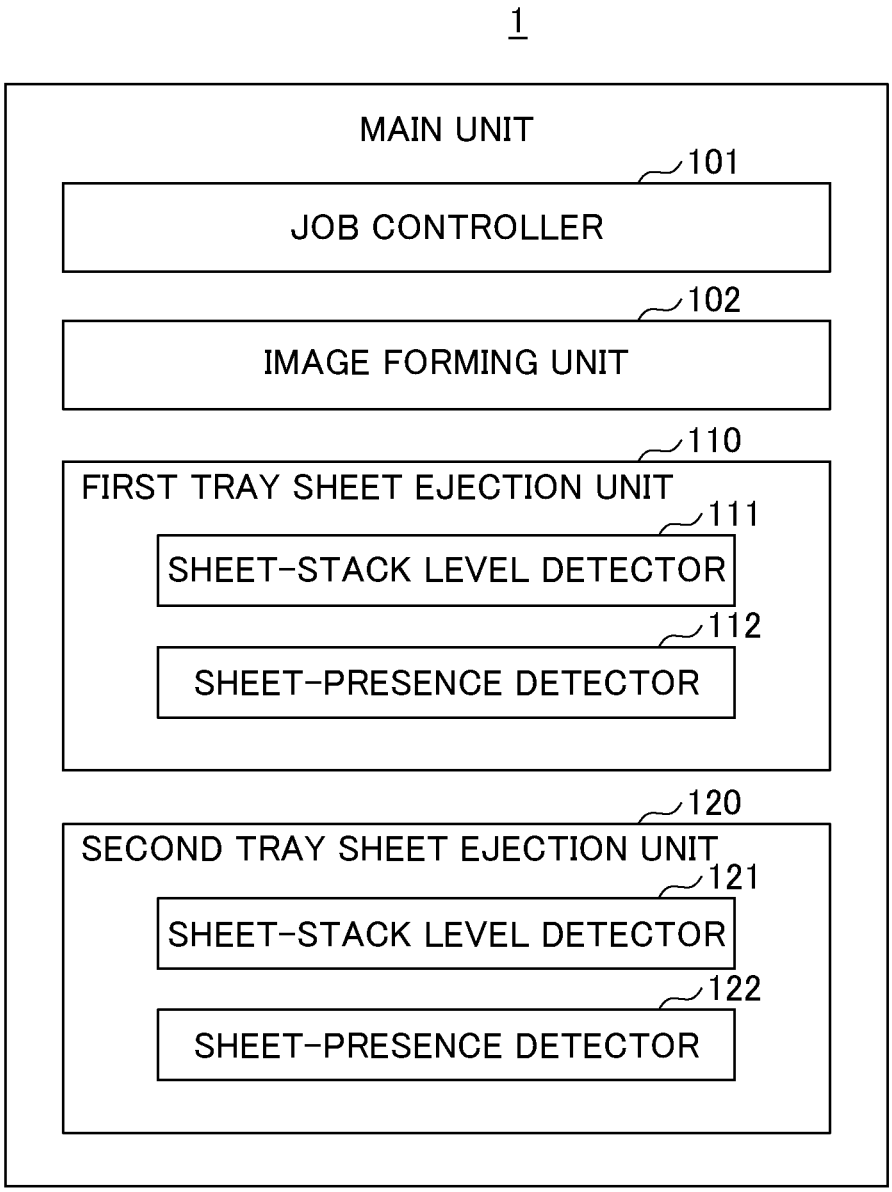
FIG. 3 is a block diagram illustrating an example of a functional configuration of the image forming apparatus, according to an embodiment of the present disclosure.

FIG. 3 is a block diagram illustrating an example of a functional configuration of the image forming apparatus 1 according to the embodiment of the present disclosure. As illustrated in FIG. 3, the image forming apparatus 1 includes a job controller 101, an image forming unit 102, a first tray sheet ejection unit 110, and a second tray sheet ejection unit 120. The first tray sheet ejection unit 110 includes a sheet stack height detector 111 and a sheet-presence detector 112. The second tray sheet ejection unit 120 includes a sheet stack height detector 121 and a sheet-presence detector 122. Each unit may be implemented by execution of a program by the CPU 11 in the image forming apparatus 1. All or part of each unit may be implemented by a different device, such as a different image forming apparatus or a user terminal connected to the image forming apparatus through a network.

The job controller 101 determines the ejection destination of a sheet, and the start, suspension, resumption, or end of a job, on the basis of a printing-job execution request from an image forming function, such as printing, copying, scanning, or faxing. The job controller 101 has a function of grasping the position of copy separation according to a job being executed.

The image forming unit 102 performs various image forming functions of the image forming apparatus. The image forming unit is mainly implemented by the printer engine 17 illustrated in FIG. 2.

The sheet stack height detector 111 detects the quantity of sheets stacked in the first ejection tray. The sheet stack height detector 121 detects the quantity of sheets stacked in the second ejection tray. The sheet stack height detectors 111 and 121 notify the job controller 101 of the detected quantity of sheets. The state where a bundle of sheets has reached the sensor at the highest position in the ejection tray is defined as the "full level", and the state where a bundle of sheets has reached the next lower sensor to the sensor corresponding to the full level is defined as the "near full level".

The sheet-presence detector 112 detects whether the first ejection tray retains any sheet and the sheet-presence detector 122 detect whether the second ejection tray retains any sheet, and the sheet-presence detectors 112 and 122 notify the job controller 101 of the detection result.

Figure 4:
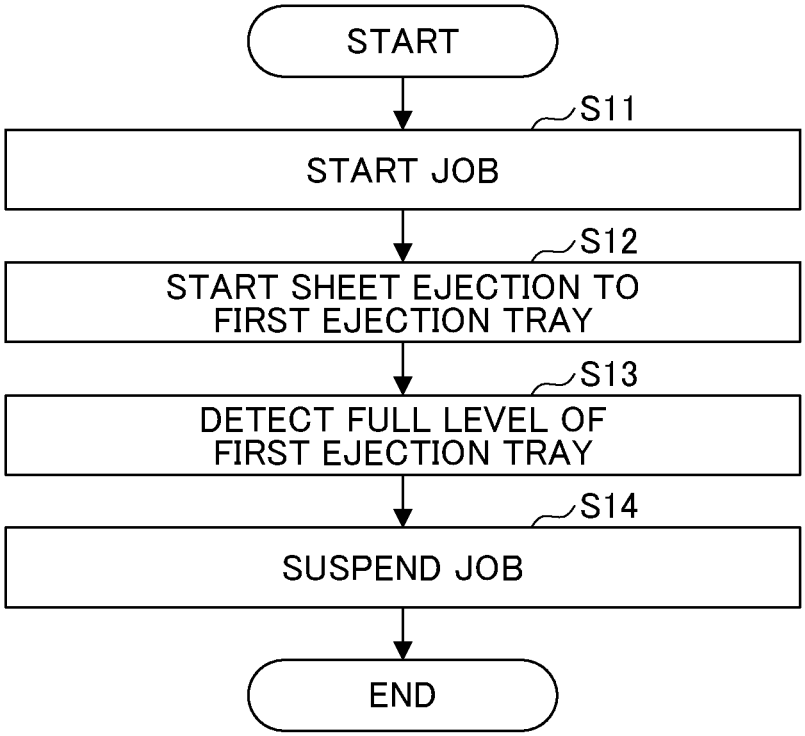
FIG. 4 is a flowchart illustrating an example of an operation of suspending a job when an ejection tray is full, according to an embodiment of the present disclosure.

FIG. 4 is a flowchart illustrating an example of an operation of suspending a job when the ejection tray is in a state of the full level. At step S11, the job controller 101 starts a job. Subsequently, the image forming unit 102 performs printing according to the job, to start sheet ejection to the first ejection tray. At step S13, when the sheet stack height detector 111 detects the full level of the first ejection tray, the job controller 101 suspends the job (S14).

As described above, when the ejection tray reaches at the full level, the job is suspended in the image forming apparatus 1.

Figure 5:
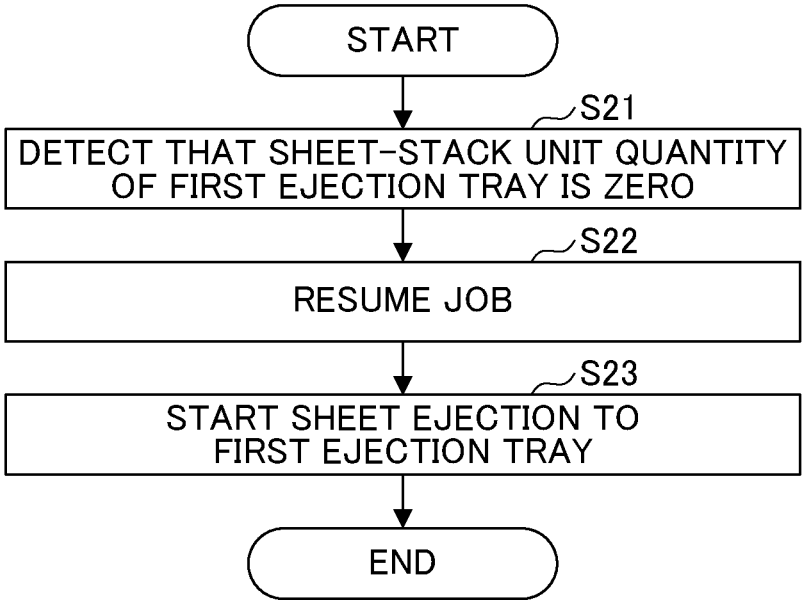
FIG. 5 is a flowchart illustrating an example of an operation for resuming a job when a full state of the ejection tray is resolved, according to an embodiment of the present disclosure.

FIG. 5 is a flowchart illustrating an example of an operation for resuming a job when a full state of the ejection tray is resolved.

It is assumed that, the operation of FIG. 5 is started after the end of the operation illustrated in FIG. 4, i.e., in a state in which a job is suspended and the first ejection tray is at the full level.

At step S21, the sheet-presence detector 112 detects that the sheet stack quantity of the first ejection tray is zero, and notifies the job controller 101 of the detection result. Subsequently, the job controller 101 resumes the job (S22). Subsequently, the image forming unit 102 resumes the printing according to the job, to start sheet ejection to the first ejection tray (S23).

As described above, after the sheets are taken out from the ejection tray while the job is suspended as the ejection tray at the full level in the image forming apparatus, printing is resumed.

Figures 6, 6A:
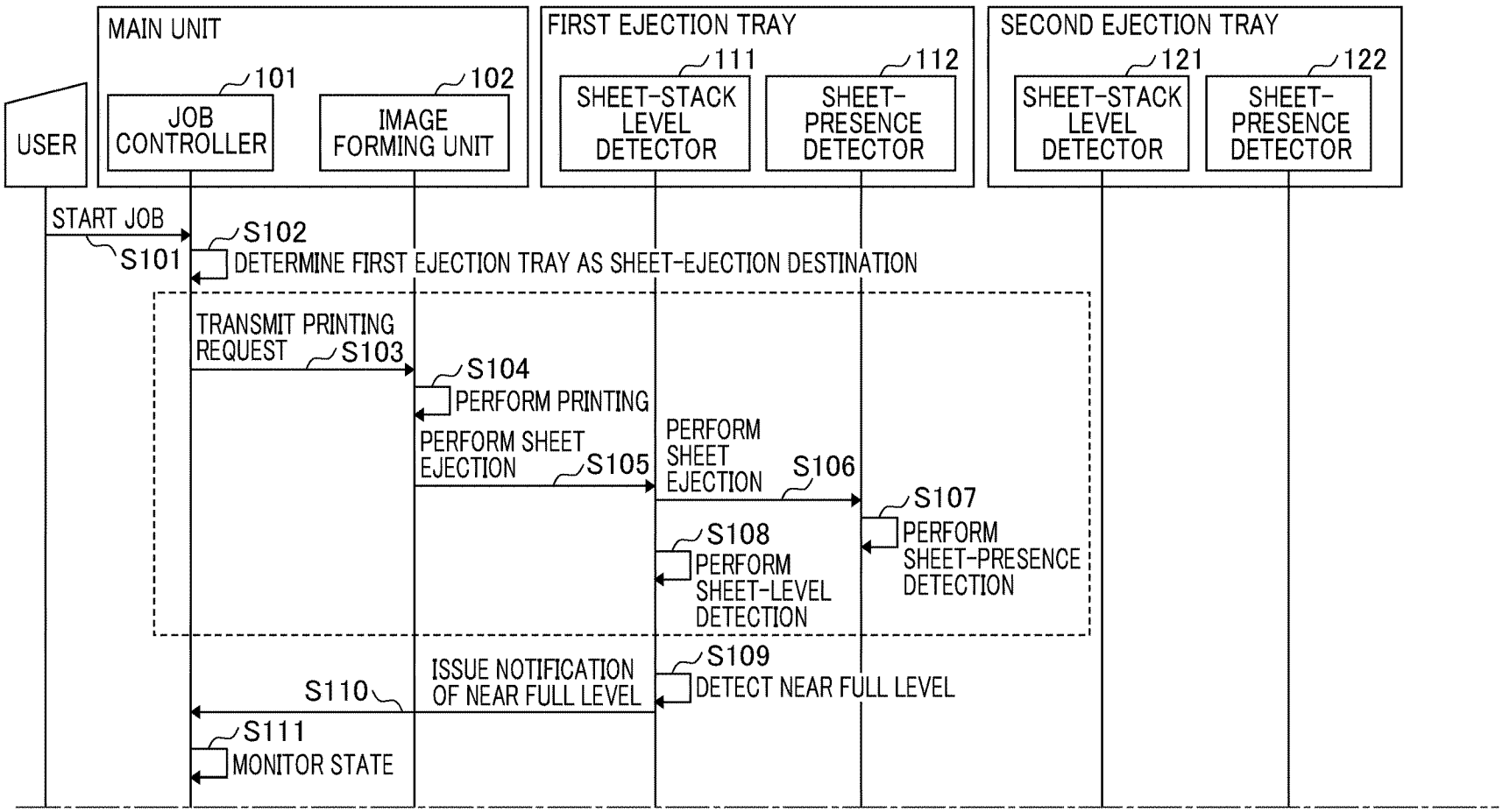
FIGS. 6A and 6B are a sequence diagram illustrating an example of an operation of processing a job, according to an embodiment of the present disclosure.
Figure 6B:
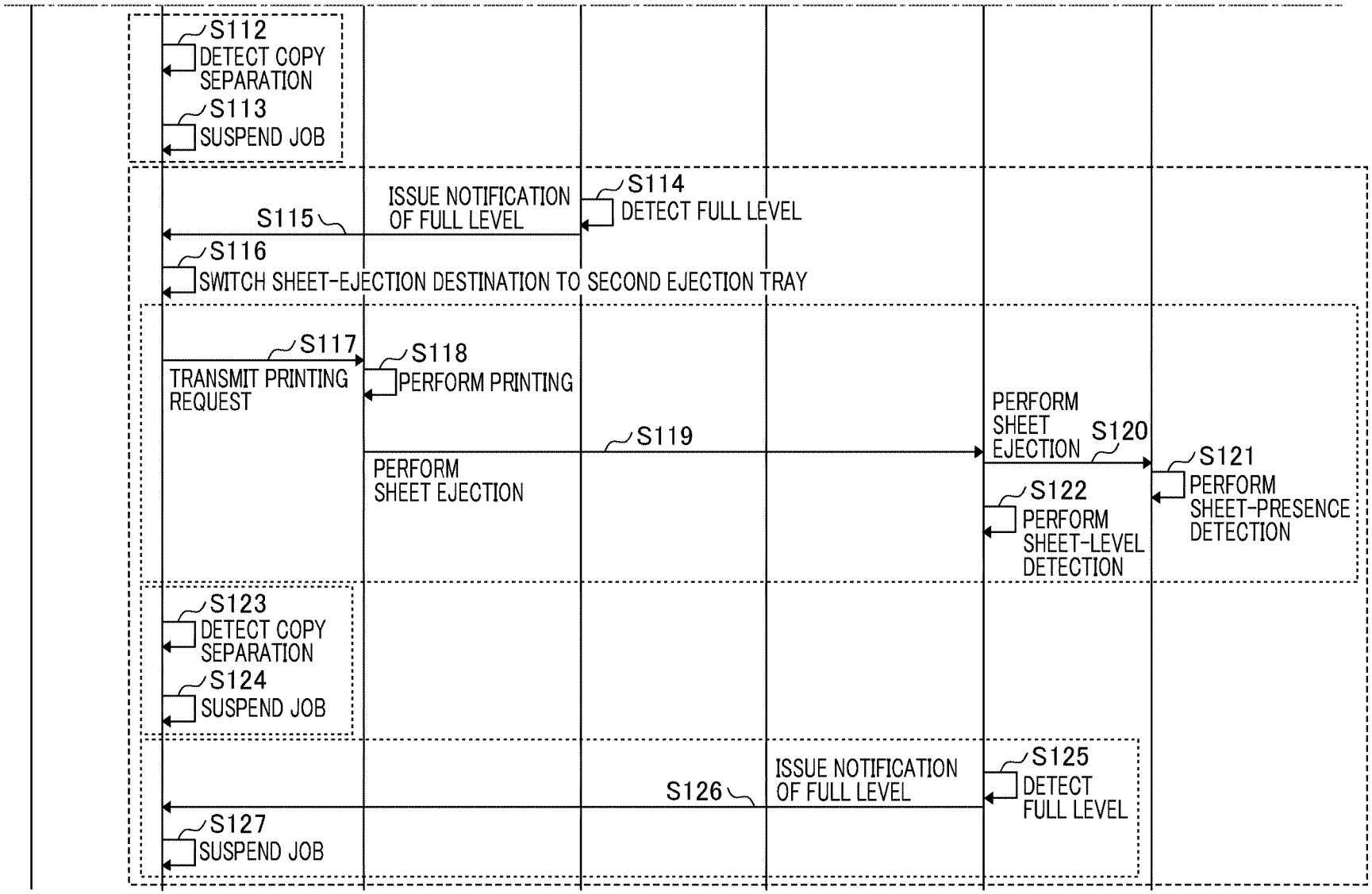

FIGS. 6A and 6B are a sequence diagram illustrating an example of an operation of processing a job, according to the embodiment of the present disclosure. With reference to FIGS. 6A and 6B, a description is given of an operation of processing a job performed when the user instructs the image forming apparatus 1 to start the job. When performing a printing job as a processing target to a plurality of sheets, the image forming apparatus 1 performs printing of one copy or a plurality of copies of a document. In the following description, a separation between one copy of the plurality of copies and the subsequent one copy of the plurality of copies is referred to as a "copy separation".

At step S101, the user instructs the job controller 101 to start the job. Subsequently, the job controller 101 determines the first ejection tray as the sheet-ejection destination (S102).

Steps S103 to S108 may include a loop to be repeated until the job is suspended. At step S103, the job controller 101 transmits a printing request to the image forming unit 102. Subsequently, the image forming unit 102 performs printing (S104). Subsequently, the image forming unit 102 ejects a printed sheet to the first ejection tray (S105 and S106). At step S107, the sheet-presence detector 112 performs sheet-presence detection. At step S108, the sheet stack height detector 111 performs sheet-level detection. The execution sequence between step S107 and step S108 can be reversed. In another example step S107 and step S108 can be performed concurrently.

At step S109, the sheet stack height detector 111 detects the "near full level". Subsequently, the sheet stack height detector 111 notifies the job controller 101 of the "near full level". Subsequently, the job controller 101 monitors a state to determine whether either one of the "copy separation" and the "full level" of the first ejection tray occurs (S111).

In a case where the "copy separation" has occurred, step S112 and step S113 are performed. By contrast, in a case where the "full level" of the first ejection tray has occurred, step S114 to step S127 are to be performed.

In a case where the "copy separation" has occurred (S112), the job controller 101 suspends the job (S113).

In a case where the "full level" of the first ejection tray has occurred, the sheet stack height detector 111 detects that the first ejection tray is at the full level (S114). Subsequently, the sheet stack height detector 111 notifies the job controller 101 that the first ejection tray is at the full level (S115).

At step S116, the job controller 101 switches the sheet-ejection destination to the second ejection tray. Subsequently, the job controller 101 transmits a printing request to the image forming unit 102 (S117). The image forming unit 102 performs printing (S118). Subsequently, the image forming unit 102 ejects a printed sheet to the second ejection tray (S119 and S120). At step S121, the sheet-presence detector 112 performs sheet-presence detection. At step S122, the sheet stack height detector 111 performs sheet-level detection. The execution sequence between step S121 and step S122 can be reversed. In another example, step S121 and step S122 can be performed concurrently. Subsequently, the job controller 101 monitors a state to determine whether the "copy separation" or the "full level" of the second ejection tray occurs. In a case where the "copy separation" has occurred, step S123 and step S124 are performed. Meanwhile, in a case where the "full level" of the second ejection tray has occurred, step S125 to step S127 are performed.

In a case where the "copy separation" has occurred (S123), the job controller 101 suspends the job (S124).

In a case where the "full level" of the second ejection tray has occurred, the sheet stack height detector 121 detects that the second ejection tray is at the full level (S125). Subsequently, the sheet stack height detector 121 notifies the job controller 101 that the second ejection tray is at the full level (S126). Subsequently, the job controller 101 suspends the job (S127).

Figure 7:
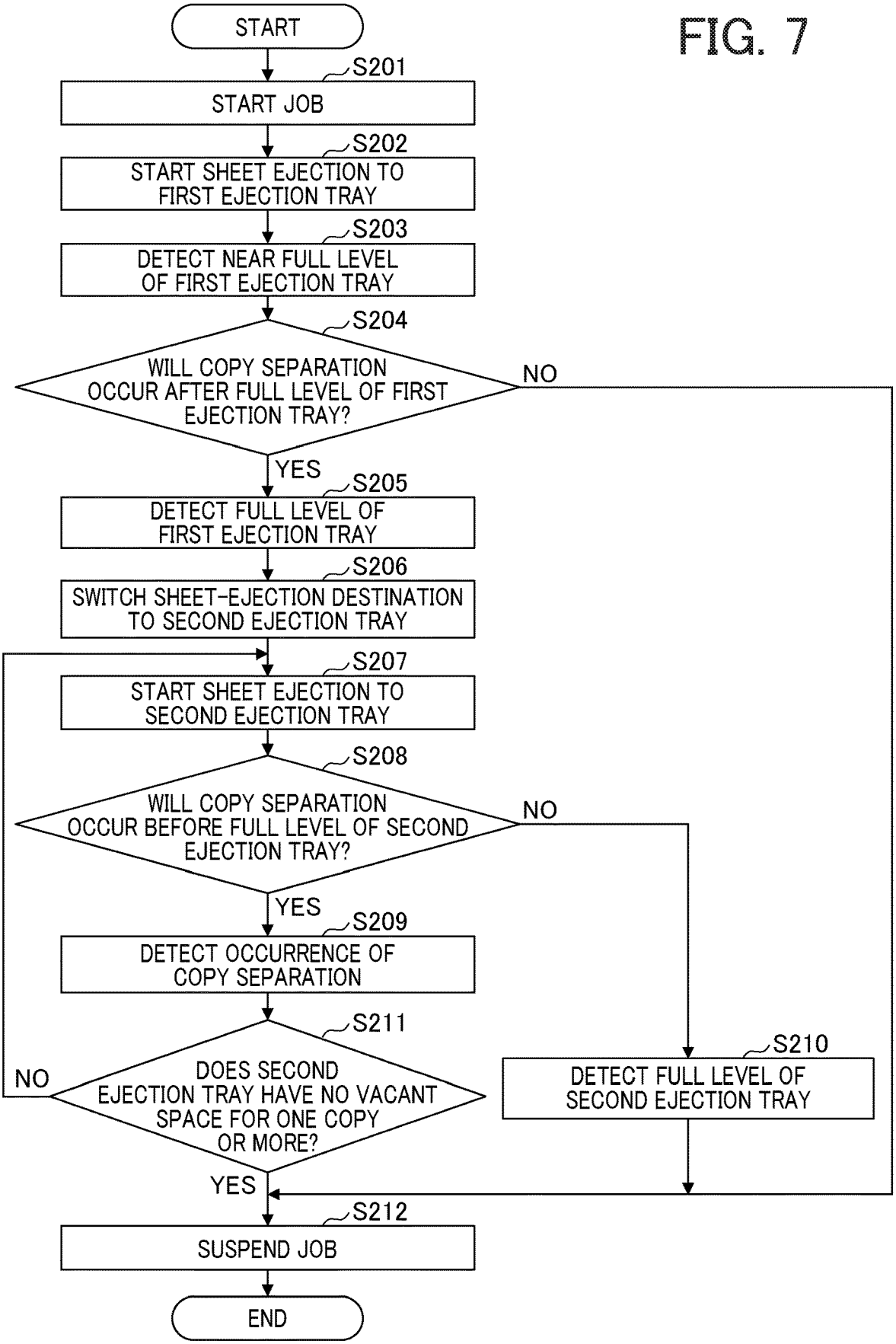
FIG. 7 is a flowchart illustrating an example of an operation of processing a job, according to an embodiment of the present disclosure.

FIGS. 7A and 7B are a flowchart illustrating an example of an operation of processing a job, according to the embodiment of the present disclosure. The operation of processing a job will be described in detail with reference to the flowchart of FIG. 7.

At step S201, the user instructs the job controller 101 to start a job. Subsequently, the job controller 101 determines the first ejection tray as the sheet-qjection destination, and the image forming unit 102 starts sheet ejection to the first ejection tray (S202).

At step S203, the sheet stack height detector 111 detects the "near full level" of the first ejection tray. Subsequently, the job controller 101 determines whether the "copy separation" will occur after the "full level" of the first ejection tray (S204). In a case where the "copy separation" will occur after the "full level" of the first ejection tray (YES at step S204), the operation proceeds to step S205. In a case where the "copy separation" will occur before the "full level" of the first ejection tray (NO at step S204), the operation proceeds to step S212.

At step S205, the sheet stack height detector 111 detects that the first ejection tray is at the full level. Subsequently, the job controller 101 switches the sheet-ejection destination to the second ejection tray (S206).

At step S207, the job controller 101 transmits a printing request to the image forming unit 102. The image forming unit 102 performs printing to start sheet ejection to the second ejection tray (S207). Subsequently, the job controller 101 determines whether the "copy separation" will occur before the "full level" of the second ejection tray. In a case where the "copy separation" will occur before the "full level" of the second ejection tray (YES at step S208), the operation proceeds to step S209. In a case where the "copy separation" will occur after the "full level" of the second ejection tray (NO at step S208), the operation proceeds to step S210.

After occurrence of the "copy separation" at step S209, the job controller 101 determines whether the second ejection tray has a vacant space for one or more copies, at step S211.

For example, in order to perform the determination at step S211, the job controller 101 acquires in advance the number of sheets of one copy according to the job as a processing target by the job controller from the user interface 15 of the image forming apparatus 1 or a printer driver performed by a personal computer (PC) connected to the image forming apparatus 1. Then, for example, the job controller 101 compares the number of sheets of the one copy with a previously acquired maximum stack capacity of the second ejection tray. Thus, the job controller 101 can determine whether the second ejection tray has a vacant space for one or more copies for the job as a processing target.

In another example, the determination at step S211, can be performed on the basis of sheet-ejection weight. The weight of sheets being currently stacked in the second ejection tray is acquired with a weight sensor provided at the second ejection tray. The difference between the previously acquired maximum stack capacity of the second ejection tray and the weight of sheets being currently stacked, is compared with the weight of sheets of one copy according to the job as a processing target. Thus, the job controller 101 can determine whether the second ejection tray has a vacant space for one or more copies for the job as the processing target. The weight of sheets of one copy according to the job as the processing target is acquired, for example, by the job controller 101 with a known configuration or method.

The way of detecting the vacant space in the second ejection tray at step S211 described above, can be used for the determination as to whether the "copy separation" will occur after the "full level" of the first ejection tray, at step S204.

In a case where the second ejection tray has no vacant space for one or more copies (YES at S211), the operation proceeds to step S212. In a case where the second ejection tray has a vacant space for one or more copies (NO at S211), the operation proceeds to step S207, and the printing continues.

At step S210, when detecting the "full level" of the second ejection tray, the sheet stack height detector 121 transmits a notification to the job controller 101. Then, the operation proceeds to step S212.

At step S212, the job controller 101 suspends the job. Then, the operation of the flowchart ends.

Figures 8, 8A:
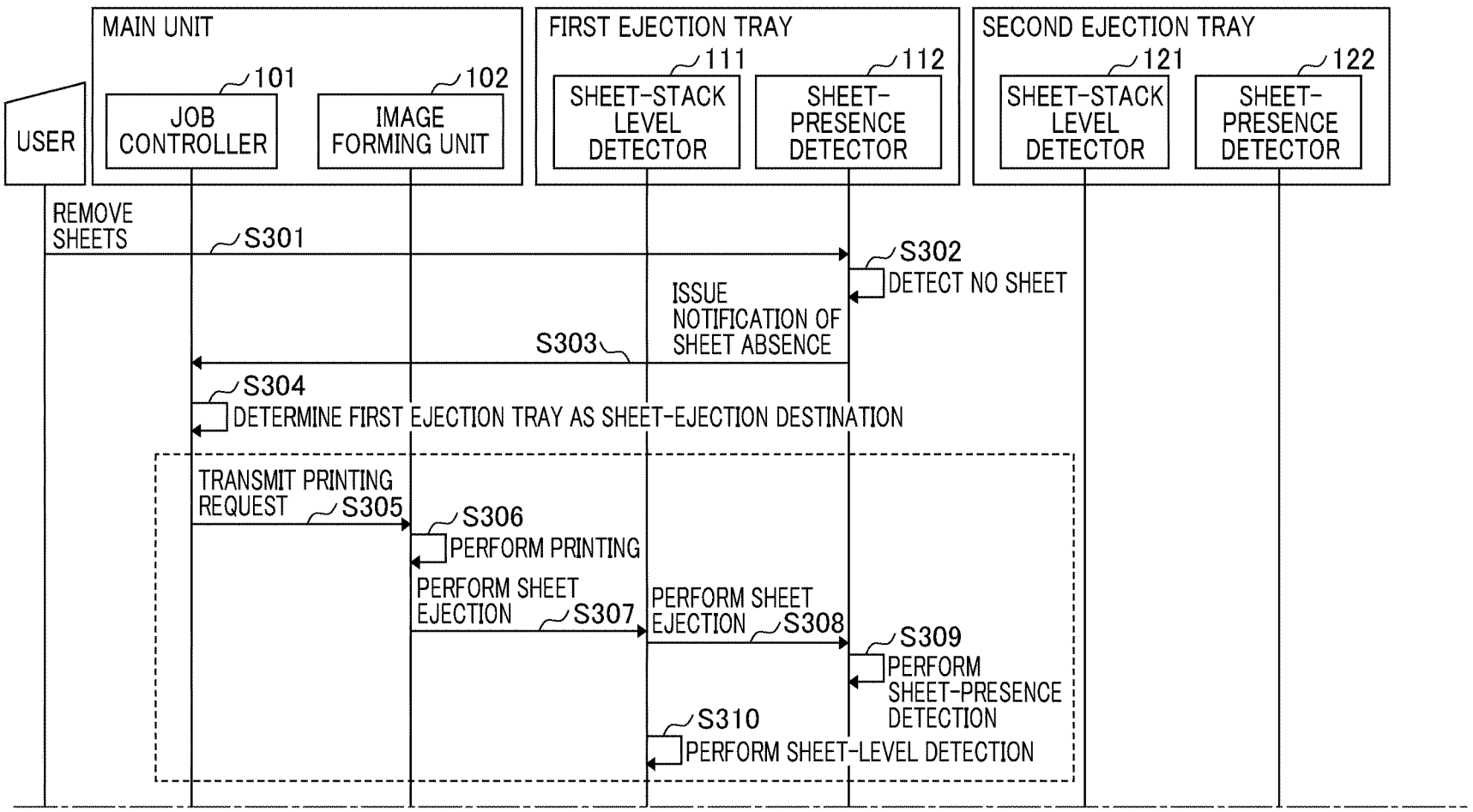
FIGS. 8A and 8B are a sequence diagram illustrating an example of an operation of resuming processing of a job, according to an embodiment of the present disclosure.
Figure 8B:
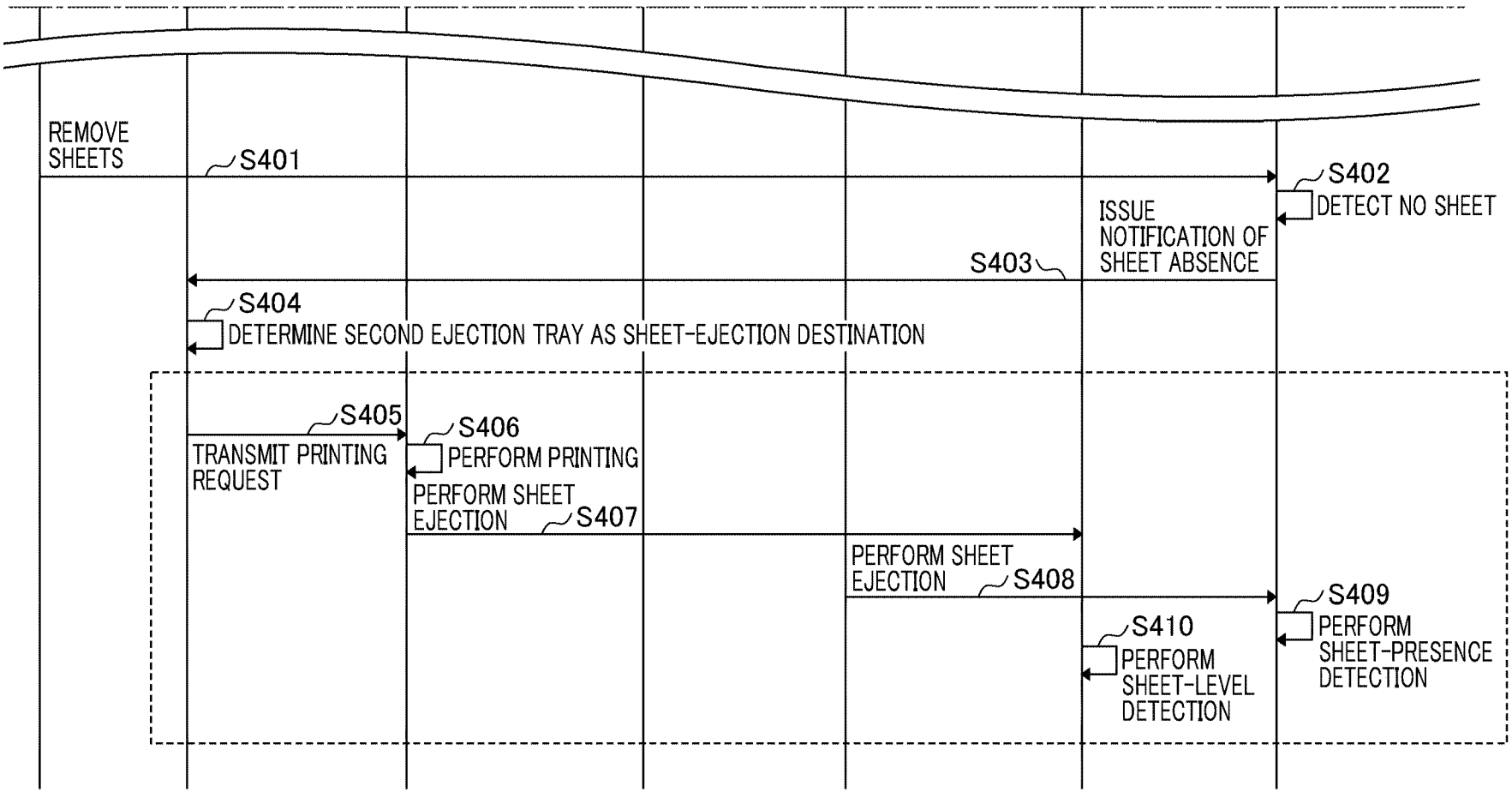

FIGS. 8A and 8B are a sequence diagram f illustrating an example of an operation of resuming processing of a job according to the embodiment of the present disclosure.

The operation for resuming processing of a job performed when the user takes out the sheets from the ejection tray, will be described with reference to FIG. 8. The operation started from step S301 is performed when the first ejection tray at the "full level". The operation started from step S401 is performed when the second ejection tray at the "full level".

At step S301, the user takes out the sheets from the first ejection tray. Subsequently, the sheet-presence detector 112 detects that no sheet is stacked in the first ejection tray (S302), and notifies the job controller 101 of sheet absence (S303). At step S304, the job controller 101 determines the first ejection tray as the sheet-ejection destination.

Steps S305 to S310 can be a loop to be repeated until the job is suspended. At step S305, the job controller 101 transmits a printing request to the image forming unit 102. Subsequently, the image forming unit 102 performs printing (S306). Subsequently, the image forming unit 102 ejects a printed sheet to the first ejection tray (S307 and S308). At step S309, the sheet-presence detector 112 performs sheet-presence detection. At step S310, the sheet stack height detector 111 performs sheet-level detection. The execution sequence between step S309 and step S310 can be reversed. In another example, step S309 and step S310 can be performed concurrently.

At step S401, the user takes out the sheets from the second ejection tray. Subsequently, the sheet-presence detector 122 detects that no sheet is stacked in the second ejection tray (S402), and notifies the job controller 101 of sheet absence (S403). At step S404, the job controller 101 determines the second ejection tray as the sheet-ejection destination.

Steps S405 to S410 can be a loop to be repeated until the job is suspended. At step S405, the job controller 101 transmits a printing request to the image forming unit 102. Subsequently, the image forming unit 102 performs printing (S406). Subsequently, the image forming unit 102 ejects a printed sheet to the second ejection tray (S407 and S408). At step S409, the sheet-presence detector 122 performs sheet-presence detection. At step S410, the sheet stack height detector 121 performs sheet-level detection. The execution sequence between step S409 and step S410 can be reversed. In another example, step S409 and step S410 can be performed concurrently.

Figure 9:
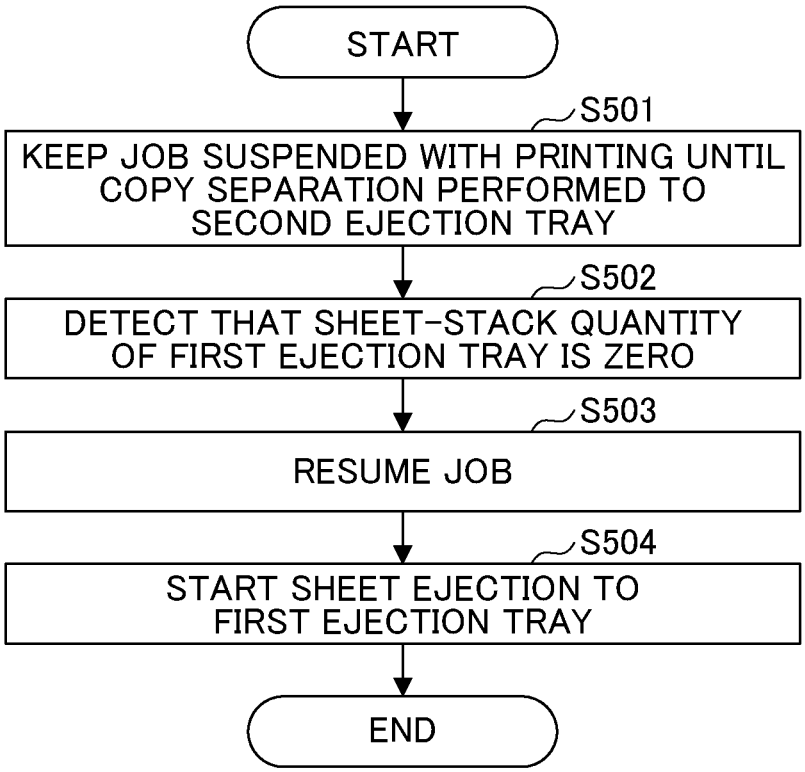
FIG. 9 is a flowchart illustrating an example of an operation of resuming a job, according to an embodiment of the present disclosure.

FIG. 9 is a flowchart illustrating an example of an operation of resuming a job according to the embodiment of the present disclosure. At step S501, the job is kept suspended after printing to the second ejection tray has been performed until the "copy separation".

At step S502, when the user takes out the sheets from the first ejection tray, the sheet stack height detector 111 detects that no sheet is stacked in the first ejection, and notifies the job controller 101 of the detection result. At step S503, the job controller 101 resumes the job. Subsequently, the image forming unit 102 ejects a printed sheet to the first ejection tray (S504).

Figure 10:
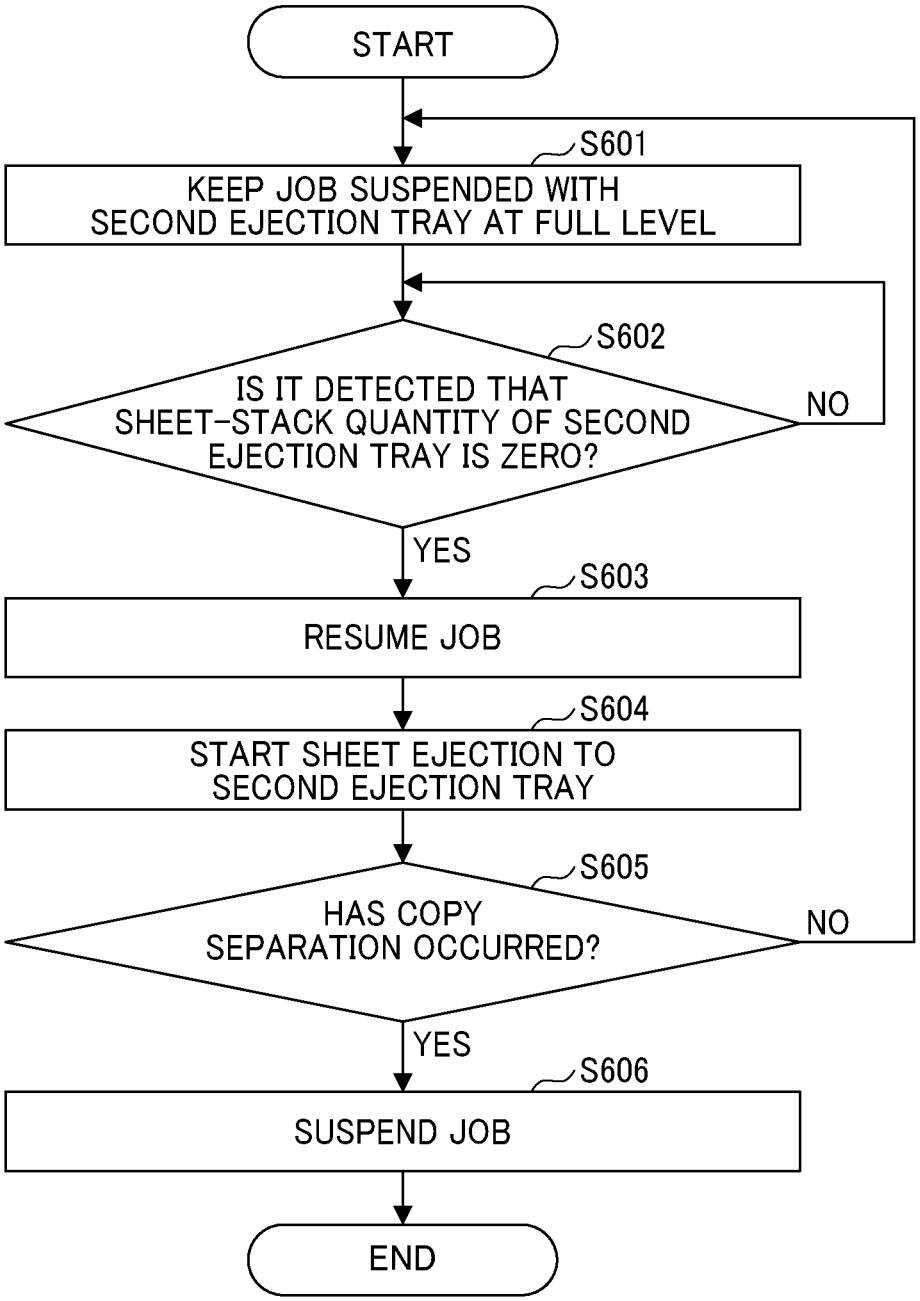
FIG. 10 is a flowchart illustrating another example of an operation of resuming a job, according to an embodiment of the present disclosure.

FIG. 10 is a flowchart illustrating another example of an operation of resuming a job, according to the present disclosure. At step S601, the job is kept suspended with the second ejection tray being at the "full level".

At step S602, it is determined whether the sheet-presence detector 122 has detected that no sheet is stacked in the second ejection tray. In a case where the user takes out the sheets from the second ejection tray and it is detected that no sheet is stacked in the second ejection (YES at S602), the operation proceeds to step S603. In a case where any sheet has not been taken out from the second ejection tray (NO at S602), the operation is on standby until it is detected that no sheet is stacked in second ejection tray.

At step S603, the job controller 101 resumes the job. Subsequently, the image forming unit 102 ejects a printed sheet to the second ejection tray (S604). At step 605, the job controller 101 determines whether the "copy separation" has occurred. In a case where the "copy separation" has occurred (YES at S605), the operation proceeds to step S606. Then, the job controller 101 suspends the job. Meanwhile, in a case where no "copy separation" has occurred (NO at S605), namely, in a case where the second ejection tray is at the "full level", the operation returns to step S601. Then, the job controller 101 suspends the job with the second ejection tray being at the "full level".

As described above, according to an embodiment of the present disclosure, the image forming apparatus 1 suspends a job in a case where the "copy separation" has occurred after detection of the "near full level" of the first ejection tray. In a case where the "full level" of the first ejection tray has occurred after detection of the "near full level" of the first ejection tray, the sheet-ejection destination can be switched to the second ejection tray. Furthermore, in a case where the "copy separation" has occurred during sheet ejection to the second ejection tray, it is determined whether the second ejection tray has a vacant space for stacking of sheets of one or more copies. In a case where the vacant space is present for one or copies, the sheet ejection continues to the second ejection tray. In a case where no vacant space is present for one or more copies, the job can be suspended.

That is, when a copy as a printing target is printed, a state is detected in which the sheets stacked in the ejection tray is less than the full level by a predetermined quantity. This enables to eject sheets of one copy collectively.

According to conventional job controlling to be performed when an ejection tray is full, a job is suspended even halfway through a copy, which is a print document, when the sheet-stack quantity of the ejection tray reaches the upper limit. In this case, the suspended job is resumed when a bundle of sheets in the ejection tray is removed. This causes "the top of a bundle of sheets printed first" and "the bottom of a bundle of sheets printed next" straddle one copy. For example, in a case a large-capacity ejection tray supporting several thousand sheets as a sheet-stack quantity is used, re-stacking of "the top of a bundle of sheets printed first" and "the bottom of a bundle of sheets printed next" causes a user to need large labor.

According to an embodiment of the present disclosure, when a copy including a plurality of sheets is printed, a sheet-stack state of an ejection tray is detected, and this enables to eject sheets of one copy collectively.

In the embodiment of the present disclosure, a copy is an example of a document. The first ejection tray is an example of a first ejection tray. The second ejection tray is an example of a second ejection tray.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus for performing printing of a plurality of copies of a document in response to execution of a printing job as a processing target, each copy of the plurality of copies of the document including a plurality of sheets, the image forming apparatus comprising:

a first ejection tray;

a second ejection tray to which a sheet is to be ejected later than the first ejection tray;

a first sensor configured to detect a full level and a near full level, which is less than the full level by a predetermined quantity of sheets, based on a quantity of sheets ejected to the first ejection tray or the second ejection tray; and circuitry configured to start sheet ejection to the first ejection tray in response to the execution of the printing job;

switch a sheet-ejection destination to the second ejection tray in response to detecting that the first ejection tray is at the full level during printing of a first copy;

calculate an amount of vacant space of the second ejection tray in response to completion of the printing of the first copy when a part of the plurality of sheets of the first copy is ejected to the second ejection tray; and perform printing of a second copy to the second ejection tray as the sheet-ejection destination or to suspend the execution of the printing job, based on the calculated amount of vacant space.

2. The image forming apparatus according to claim 1, wherein the circuitry suspends the execution of the printing job in a case where the printing of the first copy is completed before the first ejection tray is at the full level after detecting that the first ejection tray is at the near full level during the printing of the first copy.

3. The image forming apparatus according to claim 2, wherein the circuitry calculates the amount of vacant space of the second ejection tray, based on a number of the sheets of the first copy and a maximum stack capacity of the second ejection tray.

4. The image forming apparatus according to claim 2, wherein the circuitry determines whether the second ejection tray has an amount of vacant space for one or more copies, based on a weight of sheets measured by a weight sensor provided at the second ejection tray, a maximum stack capacity of the second ejection tray, and a weight of the sheets of the first copy.

5. The image forming apparatus according to claim 2, further comprising:

a second sensor configured to detect a no-sheet level at which there is no sheet ejected in the first ejection tray or the second ejection tray, wherein in a case where the no-sheet level is detected after detecting that the first ejection tray or the second ejection tray is at the full level during the printing according to the printing job, the circuitry resumes the printing according to the printing job with one of the first ejection tray and the second ejection tray in which the no-sheet level is detected as the sheet-ejection destination.

6. The image forming apparatus according to claim 5, wherein in response to detection that the second ejection tray is at the no-sheet level after detecting that the second ejection tray is at the full level during printing of a third copy according to the printing job, the circuitry resumes the printing of the third copy with the second ejection tray as the sheet-ejection destination, and suspends the execution of the printing job in a case where the printing of the third copy is completed.

7. An image forming method performed by an image forming apparatus for performing printing of a plurality of copies of a document in response to execution of a printing job as a processing target, each copy of the plurality of copies of the document including a plurality of sheets, the image forming apparatus comprising a first ejection tray and a second ejection tray to which a sheet is to be ejected later than the first ejection tray, the method comprising:

starting sheet ejection to the first ejection tray in response to the execution of the printing job;

detecting a full level and a near full level, which is less than the full level by a predetermined quantity of sheets, based on a quantity of sheets ejected to the first ejection tray or the second ejection tray;

switching a sheet-ejection destination to the second ejection tray in response to detecting that the first ejection tray is at the full level during printing of a first copy;

calculating an amount of vacant space of the second ejection tray in response to completion of the printing of the first copy when a part of the plurality of sheets included in the first copy is ejected to the second ejection tray; and performing printing of a second copy to the second ejection tray as the sheet-ejection destination or suspending the execution of the printing job, based on the calculated amount of vacant space.

8. The image forming method according to claim 7, wherein the execution of the printing job is suspended in a case where the printing of the first copy is completed before the first ejection tray is at the full level after detecting that the first ejection tray is at the near full level during the printing of the first copy.

9. The image forming method according to claim 8, wherein the amount of vacant space of the second ejection tray is calculated based on a number of the sheets of the first copy and a maximum stack capacity of the second ejection tray.

10. The image forming method according to claim 8, wherein determination as to whether the second ejection tray has an amount of vacant space for one or more copies is performed based on a weight of sheets measured by a weight sensor provided at the second ejection tray, a maximum stack capacity of the second ejection tray, and a weight of the sheets of the first copy.

11. The image forming method according to claim 8, further comprising:

detecting a no-sheet level at which there is no sheet ejected in the first ejection tray or the second ejection tray, wherein in a case where the no-sheet level is detected after detecting that the first ejection tray or the second ejection tray is at the full level during the printing according to the printing job, the printing according to the printing job is resumed with one of the first ejection tray and the second ejection tray in which the no-sheet level is detected as the sheet-ejection destination.

12. The image forming method according to claim 11, wherein in response to detection that the second ejection tray is at the no-sheet level after detecting that the second ejection tray is at the full level during printing of a third copy according to the printing job, the printing of the third copy is resumed with the second ejection tray as the sheet-ejection destination, and the execution of the printing job is suspended in a case where the printing of the third copy is completed.

13. A non-transitory computer-readable medium storing a program for causing an image forming apparatus for performing printing of a plurality of copies of a document in response to execution of a printing job as a processing target, each copy of the plurality of copies of the document including a plurality of sheets, to perform an image forming method, the image forming apparatus comprising a first ejection tray and a second ejection tray to which a sheet is to be ejected later than the first ejection tray, the method comprising:

starting sheet ejection to the first ejection tray in response to the execution of the printing job;

detecting a full level and a near full level, which is less than the full level by a predetermined quantity of sheets, based on a quantity of sheets ejected to the first ejection tray or the second ejection tray;

switching a sheet-ejection destination to the second ejection tray in response to detecting that the first ejection tray is at the full level during printing of a first copy;

calculating an amount of vacant space of the second ejection tray in response to completion of the printing of the first copy when a part of the plurality of sheets included in the first copy is ejected to the second ejection tray; and performing printing of a second copy to the second ejection tray as the sheet-ejection destination or suspending the execution of the printing job, based on the calculated amount of vacant space.

* * * * *